US010739061B2

(12) United States Patent
Fei et al.

(10) Patent No.: US 10,739,061 B2
(45) Date of Patent: Aug. 11, 2020

(54) TEMPERATURE HOMOGENIZING CONTAINER AND REFRIGERATOR HAVING SAME

(71) Applicants: QINGDAO HAIER SPECIAL REFRIGERATOR CO., LTD., Qingdao, Shandong Province (CN); QINGDAO HAIER JOINT STOCK CO., LTD., Qingdao, Shandong Province (CN)

(72) Inventors: Bin Fei, Qingdao (CN); Xueli Cheng, Qingdao (CN); Xuan Ji, Qingdao (CN); Xiaobing Zhu, Qingdao (CN)

(73) Assignees: QINGDAO HAIER SPECIAL REFRIGERATOR CO., LTD., Qingdao, Shandong Province (CN); QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 174 days.

(21) Appl. No.: 15/745,103

(22) PCT Filed: Jun. 17, 2016

(86) PCT No.: PCT/CN2016/086180
§ 371 (c)(1),
(2) Date: Jan. 15, 2018

(87) PCT Pub. No.: WO2017/177540
PCT Pub. Date: Oct. 19, 2017

(65) Prior Publication Data

US 2019/0017740 A1 Jan. 17, 2019

(30) Foreign Application Priority Data

Apr. 14, 2016 (CN) ..... 2016 1 0231264

(51) Int. Cl.
*F25D 23/06* (2006.01)
*F25B 39/02* (2006.01)
(Continued)

(52) U.S. Cl.
CPC ..... *F25D 23/061* (2013.01); *F25B 39/028* (2013.01); *F25B 41/067* (2013.01);
(Continued)

(58) Field of Classification Search
CPC ..... F28D 15/043; F28D 1/06; F28D 15/0233; F28D 15/046; F28D 2021/0068;
(Continued)

(56) References Cited

U.S. PATENT DOCUMENTS 4,015,442 A * 4/1977 Schumacher ..... F25D 19/00 62/449
5,465,782 A * 11/1995 Sun ..... F28D 15/0233 165/104.26
(Continued)

FOREIGN PATENT DOCUMENTS

CN 101493296 A 7/2009
CN 101566421 A 10/2009
(Continued)

OTHER PUBLICATIONS

CN101566421 mahcine translation (Year: 2009).*

*Primary Examiner* — Gordon A Jones
(74) *Attorney, Agent, or Firm* — Cheng-Ju Chang

(57) ABSTRACT

A temperature homogenizing container and a refrigerator having same. The container comprises a body and an accommodating space that is enclosed by the body. The body comprises several capillary tube cavities provided therein and allowing flow of a heat exchange medium. A micro-tooth structure is provided on the inner wall of each capillary tube cavity. The heat exchange medium may flow in the
(Continued)

capillary tube cavities along an extension direction of the capillary tube cavities. By setting the container body to comprise several capillary tube cavities therein, the temperature homogenizing effect and heat exchange efficiency of the container are improved; by providing the micro-tooth structure, the heat exchange efficiency is further improved; the temperature difference of different areas in the container is reduced, and temperature homogenization in the container is achieved.

13 Claims, 6 Drawing Sheets

(51) Int. Cl.

| | |
|---|---|
| ***F25D 11/00*** | (2006.01) |
| ***F25B 41/06*** | (2006.01) |
| ***F28F 1/04*** | (2006.01) |
| ***F28F 1/40*** | (2006.01) |
| *F25B 21/02* | (2006.01) |
| *F28D 21/00* | (2006.01) |
| *F25B 39/04* | (2006.01) |
| *F28D 1/06* | (2006.01) |
| *F28D 15/02* | (2006.01) |
| *F28D 15/04* | (2006.01) |

(52) U.S. Cl.
CPC ..... *F25D 11/00* (2013.01); *F25D 23/068* (2013.01); *F28F 1/04* (2013.01); *F28F 1/40* (2013.01); *F25B 21/02* (2013.01); *F25B 39/04* (2013.01); *F25B 2339/023* (2013.01); *F25B 2339/045* (2013.01); *F28D 1/06* (2013.01); *F28D 15/0233* (2013.01); *F28D 15/046* (2013.01); *F28D 2021/0068* (2013.01); *F28D 2021/0078* (2013.01); *F28F 2255/16* (2013.01); *F28F 2260/02* (2013.01)

(58) Field of Classification Search
CPC ..... F28D 2021/0078; F25D 23/068; F25D 23/061; F25D 11/00; F25B 39/028; F25B 41/067; F25B 21/02; F25B 39/04; F25B 2339/023; F25B 2339/045; F28F 1/04; F28F 1/40; F28F 2255/16; F28F 2260/02
See application file for complete search history.

(56) References Cited

U.S. PATENT DOCUMENTS

| | | | | |
|---|---|---|---|---|
| 5,737,923 | A * | 4/1998 | Gilley | F25B 21/02 165/104.26 |
| 6,100,463 | A * | 8/2000 | Ladd | H01L 35/34 136/201 |
| 10,598,442 | B2 * | 3/2020 | Liu | F28D 15/04 |
| 2009/0032226 | A1 * | 2/2009 | Huang | F28D 15/0266 165/104.26 |
| 2010/0064717 | A1 * | 3/2010 | Burn | F28D 1/06 62/353 |
| 2012/0145358 | A1 * | 6/2012 | Moon | B21C 23/085 165/104.26 |
| 2016/0363381 | A1 * | 12/2016 | Cho | F28D 15/02 |

FOREIGN PATENT DOCUMENTS

| | | | |
|---|---|---|---|
| CN | 1880892 | A | 12/2016 |
| JP | 2000-130972 | A | 5/2000 |

* cited by examiner

TEMPERATURE HOMOGENIZING CONTAINER AND REFRIGERATOR HAVING SAME

CROSS REFERENCE TO RELATED APPLICATIONS

The present application is a 35 U.S.C. § 371 National Phase conversion of International (PCT) Patent Application No. PCT/CN2016/086180, filed on Jun. 17, 2016, which further claims benefit of Chinese Patent Application No. 201610231264.7, filed on Apr. 14, 2016, the disclosure of which is incorporated by reference herein. The PCT International Patent Application was filed and published in Chinese.

TECHNICAL FIELD

The present invention relates to a temperature homogenizing container and a refrigerator having the same, which belongs to the technical field of refrigerators.

BACKGROUND

Inner containers and storage drawers are containers for storing articles in refrigerators, and the heat transfer performance thereof is a key factor affecting the performance of the refrigerators. On one hand, there is usually a temperature difference in the accommodating space for accommodating articles in the container with poor temperature equalization effect. In order to solve this problem, usually a plurality of outlets has to be provided to reduce the temperature difference, making the refrigerator structure complex and cost increased. On the other hand, the conventional inner container structure is to transfer cooling by adhering to an evaporator or a pipeline on the back to realize the reduction and maintenance of the temperature. However, due to local cooling and poor heat conduction of plastics, the temperature equalization effect of the inner container is poor, and the cooling capacity leaks due to the slow heat exchange rate between the cooling system and the inner container. Thus, it is necessary to provide a container with a rapid heat exchange rate and good temperature equalization effect.

SUMMARY

In order to solve at least one of the above technical problems, an object of the present invention is to provide a temperature homogenizing container and a refrigerator having the same, which can not only improve the temperature equalization effect and heat conduction efficiency but also has a simple process and low production costs.

In order to realize one of the above invention objects, an embodiment of the present invention provides a temperature homogenizing container for a refrigerator. The container comprises a body and an accommodating space enclosed by the body and provided for accommodating articles, wherein the body comprises a plurality of capillary tube cavities provided therein and provided for a heat exchange medium to flow, the inner wall of the capillary tube cavity being provided with a micro-tooth structure, and the heat exchange medium being capable of flowing in the capillary tube cavity along the extension direction of the capillary tube cavity.

As an improvement to an embodiment of the present invention, the body is integrally formed of a highly heat-conductive material by means of an extrusion process and the capillary tube cavity is formed inside the body.

As a further improvement to an embodiment of the present invention, some capillary tube cavities are provided as independently closed spaces filled with the heat exchange medium respectively, the heat exchange medium flowing circularly in the capillary tube cavities.

As a further improvement to an embodiment of the present invention, at least some of the capillary tube cavities comprise a first opening and a second opening provided oppositely along the extension direction thereof and the heat exchange medium is capable of flowing into and out of the capillary tube cavities through the first opening and the second opening.

As a further improvement to an embodiment of the present invention, the refrigerator comprises a cooling system pipeline, and the capillary tube cavities communicate with the cooling system pipeline through the first opening and the second opening so that the heat exchange medium is capable of flowing circularly in the capillary tube cavities and the cooling system pipeline.

As a further improvement to an embodiment of the present invention, the container is provided as an inner container of the refrigerator.

As a further improvement to an embodiment of the present invention, the body comprises a first wall and a third wall provided oppositely, a second wall and a fourth wall provided oppositely and a bottom wall perpendicular to the first wall, the third wall, the second wall and the fourth wall, and at least some of the capillary tube cavities are provided throughout the first wall, the second wall, the third wall and the fourth wall successively along the extension directions thereof.

In order to realize one of the above invention objects, an embodiment of the present invention also provides a refrigerator comprising a temperature homogenizing container mentioned above and a cooling system.

As a further improvement to an embodiment of the present invention, the cooling system comprises an evaporator or a condenser provided on the outside of the container.

As a further improvement to an embodiment of the present invention, the cooling system further comprises a cooling system pipeline and a three-way valve, the capillary tube cavity of the container is capable of selectively communicating with the cooling system pipeline through the three-way valve, wherein when the capillary tube cavity communicates with the cooling system pipeline, the heat exchange medium is capable of flowing circularly between the capillary tube cavity and the cooling system pipeline.

In order to realize one of the above invention objects, an embodiment of the present invention also provides a semiconductor cooling refrigerator comprising a temperature homogenizing container mentioned above and a semiconductor cooling plate for cooling, the cool end or the heat end of the semiconductor cooling plate being adhesively provided on the surface of the container.

Compared to the prior art, the present invention has the following beneficial effects: the temperature equalization effect and heat exchange efficiency of the container are greatly improved by providing a plurality of capillary tube cavities in the container body and causing the heat exchange medium to flow in the capillary tube cavities; not only the contact surface is increased by also the heat exchange medium can form capillarity along the micro-tooth structure by providing the micro-tooth structure, further enhancing the heat exchange efficiency; the temperature difference of different regions in the accommodating space can be reduced by means of the rapid heat transfer of the container body, realizing temperature equalization in the container;

and the container body is formed integrally, thus the processing is simple and the production cost can be reduced.

DETAILED DESCRIPTION

Hereinafter, the present invention will be described in detail in combination with the particular embodiments shown in the accompanying drawings. However, these embodiments do not limit the present invention, and the structure, method or function transforms made by those skilled in the art according to these embodiments are all contained in the protection scope of the present invention.

It should be understood that unless explicitly defined and stated otherwise, in the description of the present invention, the orientation or location relationships indicated by terms "center", "longitudinal", "lateral", "upper", "lower", "front", "back", "left", "right", "vertical", "horizontal", "top", "bottom", "inner", and "outer" are orientation or location relationships shown in the figure, which is merely for the sake of describing the present invention and simplifying the description rather than indicating or implying that the referred device or element must have a specific orientation, be constructed and operated with a specific orientation and thus shall not be understood as a limitation to the present invention. In addition, terms "first" and "second" are merely used for description and shall not be understood as indicating or implying relative importance.

Figure 1:
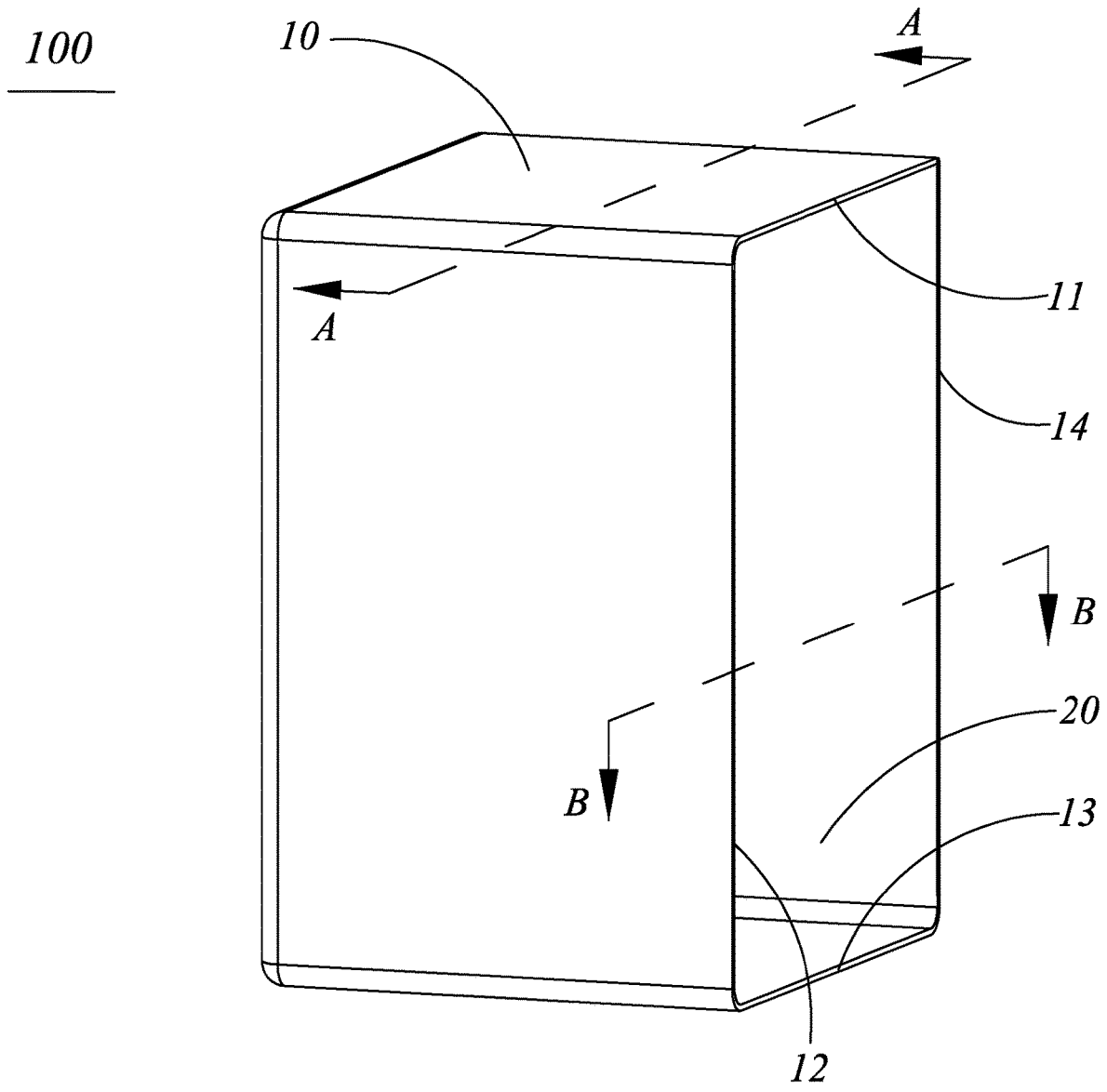
FIG. 1 is a structure diagram of a temperature homogenizing container according to an embodiment of the present invention.

Referring to FIG. 1, a temperature homogenizing container 100 is provided according to an embodiment of the present invention, in particular a temperature homogenizing container applied in a refrigerator, such as an inner container, a storage drawer, an unfreezing box and so on which needs to keep the inner temperature stabilized and may be used for the refrigeration or unfreezing of articles.

The container 100 includes a body 10 and an accommodating space 20 enclosed by the body 10. The accommodating space 20 may be used for accommodating articles. In particular, the body 10 includes an opening, a first wall 11 and a third wall 13 provided oppositely, a second wall 12 and a fourth wall 14 provided oppositely and a bottom wall provided opposite to the opening. The bottom wall is perpendicular to the first wall 11, the second wall 12, the third wall 13 and the fourth wall 14. The user may use the accommodating space 20 to take out or place articles through the opening.

Figure 2:
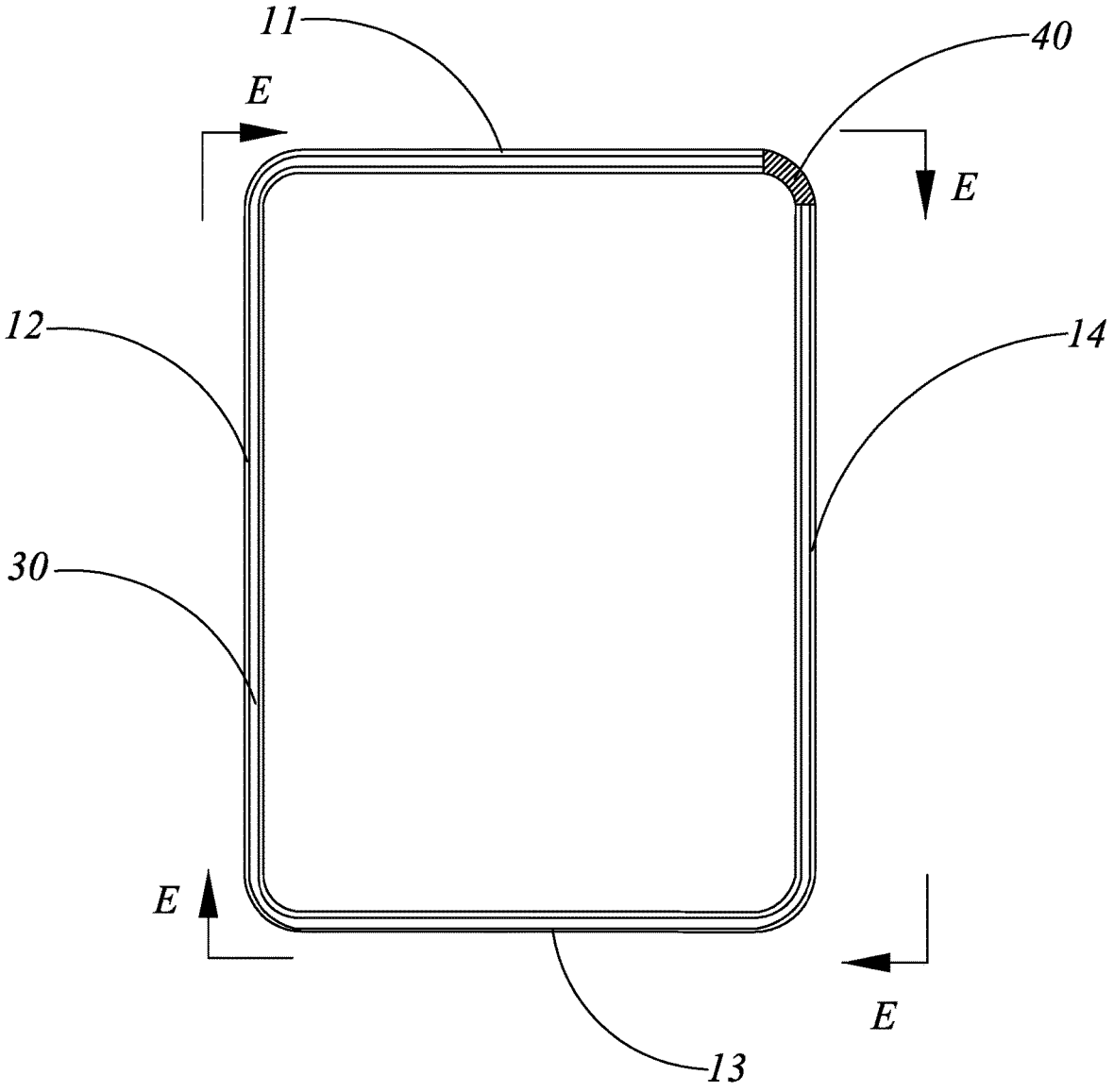
FIG. 2 is a sectional view along the line A-A in FIG. 1.
Figure 3:
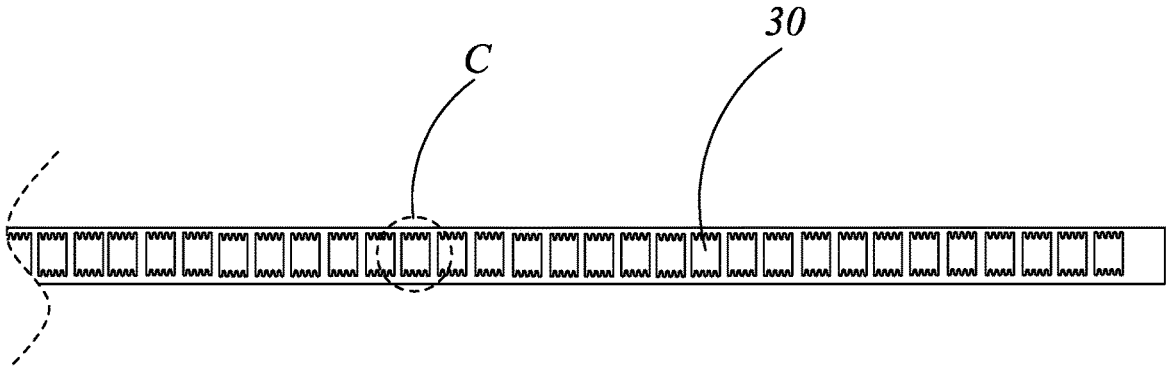
FIG. 3 is a partial sectional view along the line B-B in FIG. 1.

Referring to FIGS. 2 and 3, the body 10 is integrally formed of a highly heat-conductive material by means of an extrusion process. The highly heat-conductive material includes, but is not limited to, aluminum alloy, copper or steel and so on. The body 10 further includes a plurality of capillary tube cavities 30 formed therein. Each capillary tube cavity 30 may be provided for a heat exchange medium to flow. The heat exchange medium may perform direct heat exchange with the ambient environment of the body 10. Preferably, the heat exchange medium may be provided as alcohol or R134a (full name 1, 1, 1, 2-tetrafluoroethane).

In addition, the plurality of capillary tube cavities 30 are distributed evenly side by side inside the body 10 parallel to the inner surface/outer surface of the body 10 so that on one hand the heat exchange rate can be improved and on the other hand can also improve the temperature equalization effect.

Figure 4:
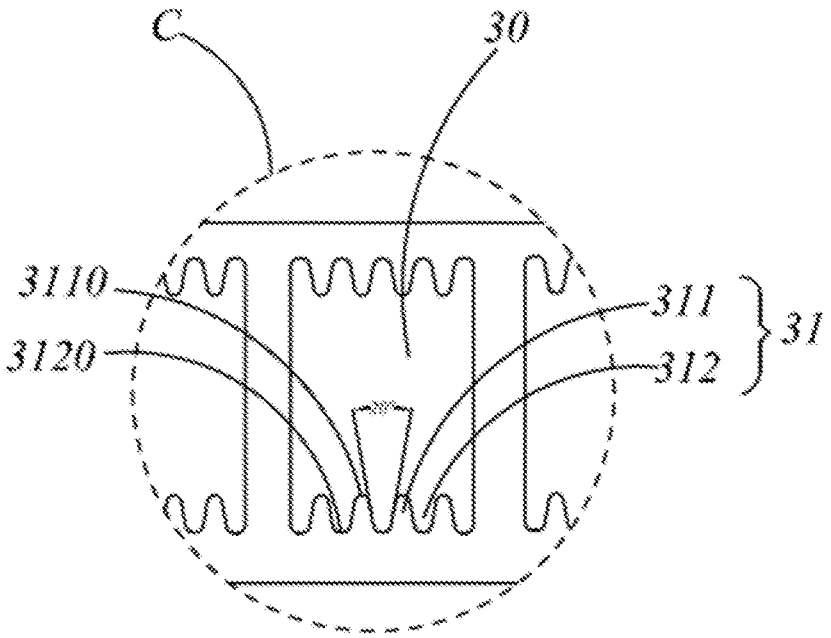
FIG. 4 is a partial enlargement diagram of region C in FIG. 3.

Referring to FIG. 4, each capillary tube cavity 30 is provided as elongate and provided with a micro-tooth structure 31 on the inner wall thereof. When there is a temperature difference between the body 10 and the ambient temperature thereof, the heat exchange medium may flow in the each capillary tube cavity 30 along an extension direction of the each capillary tube cavity 30 to accelerate the heat exchange rate, and the each capillary tube cavity 30 is ring-shaped as shown in FIG. 2, and the extension direction is a circumferential direction of the each capillary tube cavity 30 as shown as arrows E in FIG. 2. Furthermore, due the provision of the micro-tooth structure 31, on one hand, the contact surface between the heat exchange medium and the inner wall of the capillary tube cavity 30 may be increased. At the same time the heat exchange medium may form capillarity at the micro-tooth structure 31, greatly increasing the heat exchange rate. Thus, temperature equalization may be realized in the body 10 and the accommodating space 20. The flowing may be incurred by the phase change of the heat exchange medium or incurred by an external pressure and so on, which all belong to the scope of flowing.

Furthermore, the micro-tooth structure 31 includes micro combs 311 distributed continuously and a plurality of comb grooves 312, and each comb groove 312 is located between two adjacent micro combs 311. The micro-tooth structure 31 is provided so that the comb groove 312 extends along the extension direction of the capillary tube cavity 30 so that the heat exchange medium may flow to form capillarity along the comb groove 312.

In an embodiment of the present invention, on the longitudinal cross section of the capillary tube cavity 30, the micro-tooth structure 31 is provided of a wave shape. The comb groove 312 includes valleys 3120 away from the center of the capillary tube cavity 30. The valleys 3120 are provided of an arc shape so that the flowing rate of the heat exchange medium at the valleys 3120 can be avoided from lowering due to excessive resistance and the flowing of the heat exchange medium can be smoother. Likewise, the micro combs 311 include peaks 3110 close to the center of the capillary tube cavity 30. The peaks 3110 are also provided of an arc shape. The valleys 3120 and the peaks 3110 provided in arc shapes may also reduce the formation difficulty of the body 10 and ensure the product quality.

On the longitudinal cross section of the capillary tube cavity 30, the inner wall of the capillary tube cavity 30 is provided of a rectangular shape. The micro-tooth structure 31 is at least provided on any side of the four sides of the inner wall of the capillary tube cavity 30.

The included angle between two adjacent micro combs is approximately 20 degrees.

During practical production, the body 10 may be formed by forming a plate body having the capillary tube cavity 30 therein with a highly heat-conductive material by means of an extrusion process and then bending, bonding and/or welding the plate body 10.

Continuing referring to FIG. 2, the first wall 11, the second wall 12, the third wall 13, the fourth wall 14 and the bottom wall are all formed by the plate body having the capillary tube cavity 30 therein. That is, the first wall 11, the second wall 12, the third wall 13, the fourth wall 14 and the bottom wall are all provided with the capillary tube cavity 30 so that the entire body 10 may have better heat exchange efficiency and realize temperature equalization.

Furthermore, at the first wall 11, the second wall 12, the third wall 13, and the fourth wall 14, at least some of the capillary tube cavities 30 are provided so that the capillary tube cavity 30 passes through the first wall 11, the second wall 12, the third wall 13, and the fourth wall 14 successively along the extension directions thereof.

In addition, arc transition is provided between the first wall 11 and the second wall 12, between the second wall 12 and the third wall 13, as well as between the third wall 13 and the fourth wall 14 respectively so that the capillary tube cavity 30 may transition in an arc shape and further the heat exchange medium may be prevented from flowing not smoothly. In the embodiment shown in FIG. 1, the container 100 further includes a welding portion 40. The fourth wall 14 and the first wall 11 are connected through the welding portion 40. During practical production, the fourth wall 14 and the first wall 11 are connected through welding.

In an embodiment of the present invention, in the plurality of capillary tube cavities 30, any two capillary tube cavities 30 are separated from each other in the body 10 without communication.

In the embodiment shown in FIG. 1, some capillary tube cavities 30 are provided as independently closed spaces filled with the heat exchange medium respectively. The heat exchange medium flows circularly in the capillary tube cavity. That is, the capillary tube cavity 30 does not communicate with the external space of the body 10. The heat exchange medium can only flow circularly in the capillary tube cavity 30.

Figure 5:
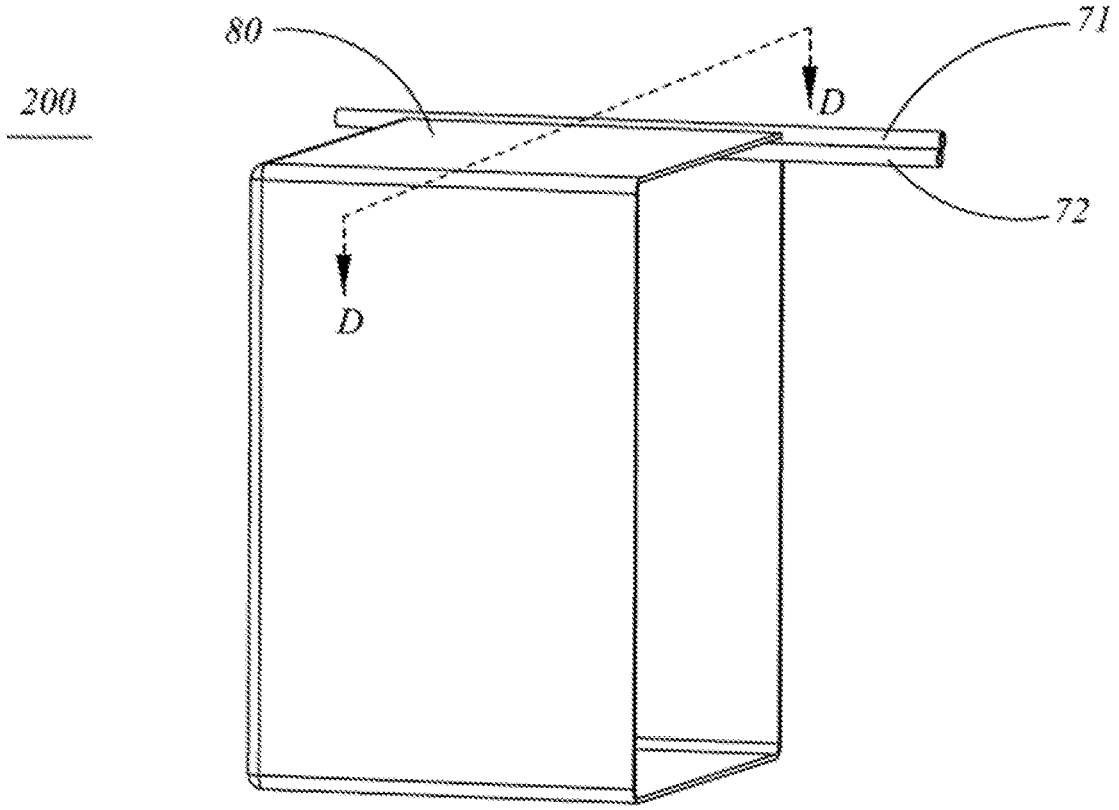
FIG. 5 is a structure diagram of a temperature homogenizing container according to another embodiment of the present invention.
Figure 6:
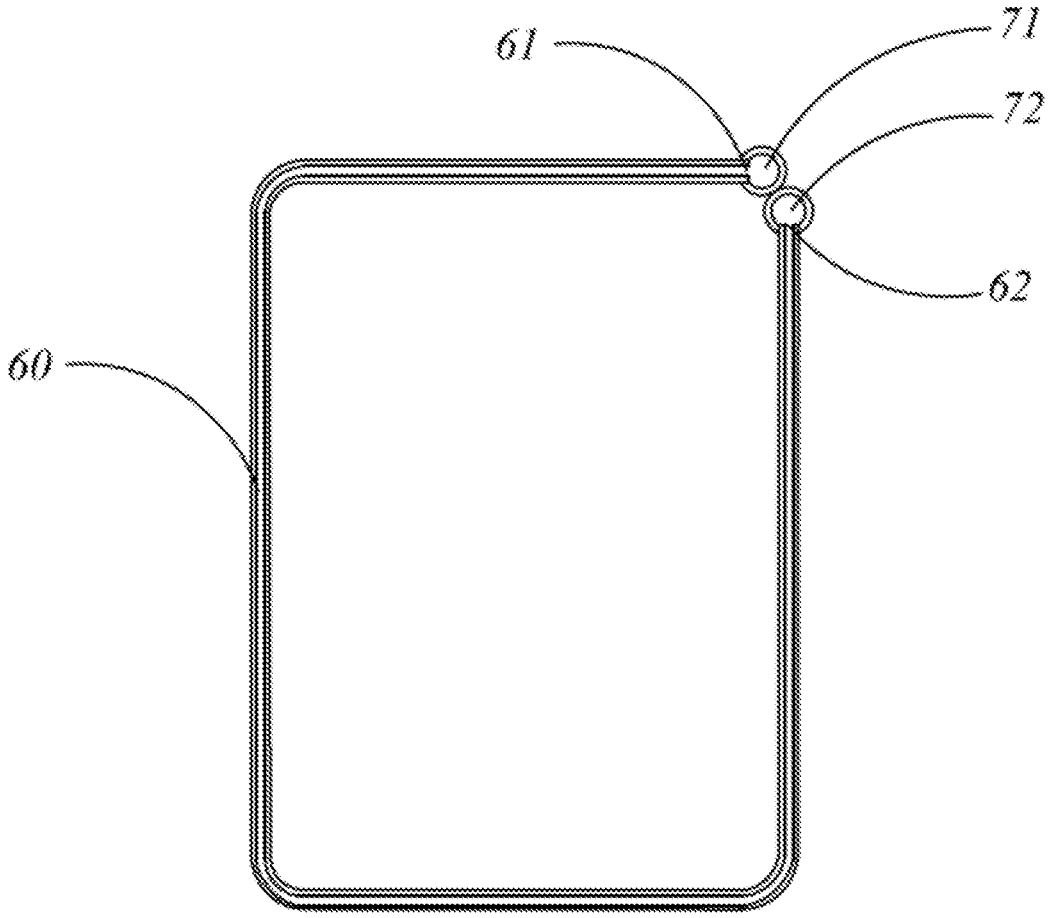
FIG. 6 is a sectional view along the line D-D in FIG. 5.

Referring to FIGS. 5 and 6, a temperature homogenizing container 200 according to another embodiment is shown. The main difference between this embodiment and the embodiment shown in FIG. 1 lies in that: in this embodiment, at least some of the capillary tube cavities 60 are provided as an open space. In particular, at least some of the capillary tube cavities 60 include a first opening 61 and a second opening 62 provided oppositely along the extension direction thereof. The heat exchange medium may flow into and out of the capillary tube cavity 60 through the first opening 61 and the second opening 62. That is, the capillary tube cavity 60 may communicate with other devices accommodating the heat exchange medium through the first opening 61 and the second opening 62. In an embodiment of the present invention, the other devices may be provided as a cooling system pipeline of the refrigerator.

The container 200 may further include a first communication pipe 71 and a second communication pipe 72 connected to the body 10 through welding. When the container 200 is provided in the refrigerator, the first communication pipe 71 enables the first openings 61 of the capillary tube cavities 60 to communicate with the cooling system pipeline of the refrigerator. Accordingly, the second communication pipe 72 enables the second openings 62 of the capillary tube cavities 60 to communicate with the cooling system pipeline of the refrigerator. Thus, the circular flowing of the heat exchange medium between the capillary tube cavity 60 and the cooling system pipeline is realized.

Of course, in other embodiments of the present invention, the temperature homogenizing container may also be provided so that some capillary tube cavities are provided as a closed space and the remaining capillary tube cavities are provided as an open space. The particular structure of the capillary tube cavity may be made reference to the above embodiment, which will not be described here anymore.

Accordingly, a refrigerator comprising a temperature homogenizing container mentioned above and a cooling system is also provided according to an embodiment of the present invention. Furthermore, the container is provided as an inner container of the refrigerator.

Figure 7:
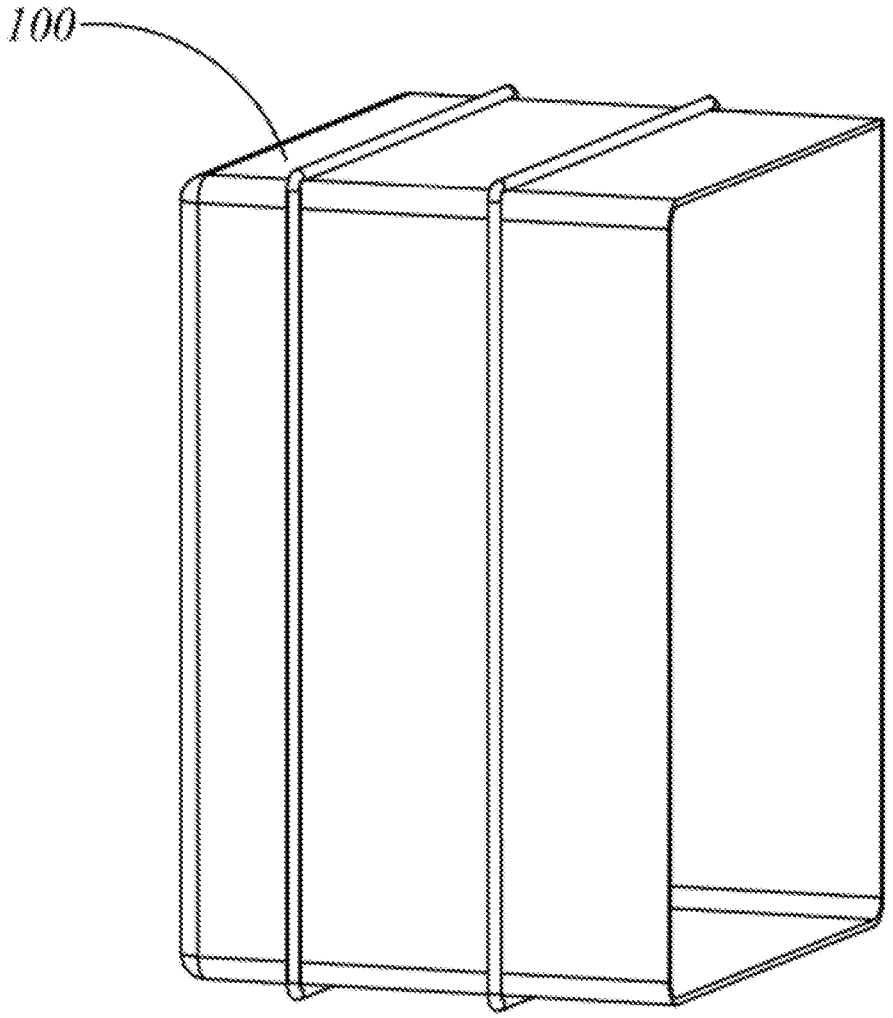
FIG. 7 is a structure diagram of a temperature homogenizing container combined with a cooling system according to an embodiment of the present invention.

Referring to FIG. 7, in the embodiment shown in FIG. 7, the refrigerator includes the container 100 mentioned above. The cooling system includes an evaporator and a condenser. The evaporator or the condenser is provided at the outside of the container 100 in a winding manner so that the container 100 may be used as a refrigeration container or a heating container. As such, on one hand, the direct contact area between the cooling system and the body 10 of the container 100 increases, increasing the heat exchange efficiency. On the other hand, the provision of the capillary tube cavities 30 of the body 10 further increases the heat transfer performance of the body 10, realizing temperature equalization of the body 10 and indirectly achieving the temperature equalization effect of the accommodating space 20.

In another embodiment, the capillary tube cavity may also be configured to communicate with the cooling system pipeline so that the heat exchange medium may flow circularly between the capillary tube cavity and the cooling system pipeline.

Preferably, the cooling system also includes a three-way valve. The capillary tube cavity of the container may selectively communicate with the cooling system pipeline through the three-way valve. When the capillary tube cavities communicate with the cooling system pipeline, the heat exchange medium may flow circularly between the capillary tube cavities and the cooling system pipeline. When the capillary tube cavity does not communicate with the cooling system pipeline, the heat exchange medium may flow circularly in the capillary tube cavity.

Figure 8:
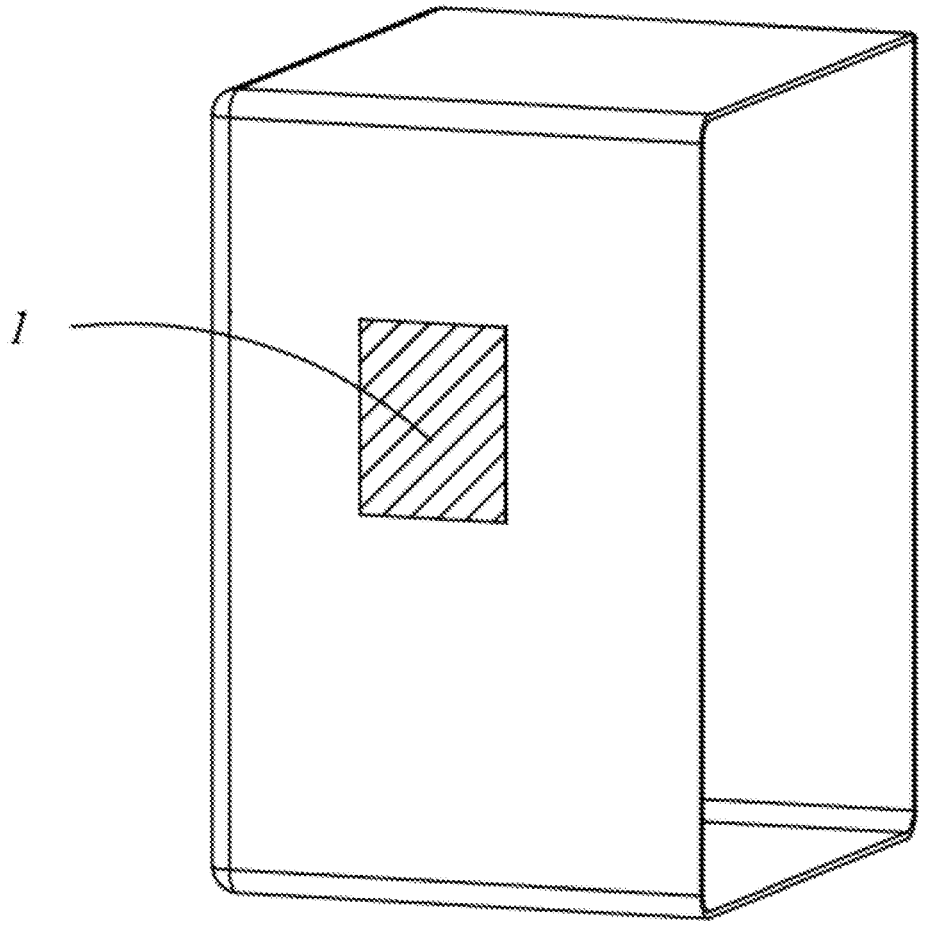
FIG. 8 is a structure diagram of a temperature homogenizing container combined with a semiconductor cooling plate according to an embodiment of the present invention.

In addition, referring to FIG. 8, a semiconductor cooling refrigerator including a temperature homogenizing container mentioned above and a semiconductor cooling plate 1 for cooling is also provided according to an embodiment of the present invention. The cool end or the heat end of the semiconductor cooling plate is adhesively provided on the surface of the container to realize the direct heat transfer between the container and the semiconductor cooling plate. When there is a temperature difference between the hot end or the cool end and the container, the heat exchange medium in the body of the container may flow along the capillary tube cavity so as to transfer the heat capacity or the cool capacity to a location on the body away from the hot end or the cool end, thus realizing rapid temperature equalization of the container.

Compared to the prior art, the present invention has the following beneficial effects: the temperature equalization effect and heat exchange efficiency of the container are greatly improved by providing a plurality of capillary tube cavities in the container body and causing the heat exchange medium to flow in the capillary tube cavities; not only the contact surface is increased by also the heat exchange medium can form capillarity along the micro-tooth structure by providing the micro-tooth structure, further enhancing the heat exchange efficiency; the temperature difference of different regions in the accommodating space can be reduced by means of the rapid heat transfer of the container body, realizing temperature equalization in the container; and the container body is formed integrally, thus the processing is simple and the production cost can be reduced.

The detailed description listed above is merely a particular description of feasible embodiments of the present invention which is not used to limit the protection scope of the present invention. All equivalent embodiments or changes made without departing from the technical spirit of the present invention shall be included within the protection scope of the present invention.

What is claimed is:

1. A temperature homogenizing container for a refrigerator, comprising a body and an accommodating space enclosed by the body and provided for accommodating articles, wherein the body comprises a plurality of capillary tube cavities provided therein and provided for a heat exchange medium to flow therein, an inner wall of each capillary tube cavity of the plurality of capillary tube cavities being provided with a micro-tooth structure comprising micro combs and a plurality of comb grooves each of which is located between two adjacent micro combs, and the heat exchange medium being capable of flowing in the each capillary tube cavity along an extension direction of the each capillary tube cavity;

the body is integrally formed of a highly heat-conductive material through an extrusion process and then bending, the each capillary tube cavity is formed inside the body, the plurality of capillary tube cavities are distributed evenly side by side inside the body parallel to an inner surface of the body, each comb groove includes a valley away from a center of the each capillary tube cavity, each micro comb includes a peak close to the center of the each capillary tube cavity, and the valley and the peak are respectively provided with an arc shape.

2. The temperature homogenizing container for the refrigerator according to claim 1, wherein some of the plurality of capillary tube cavities are provided as independently closed spaces filled with one of a plurality of heat exchange mediums respectively, the heat exchange medium is one of the one of a plurality of heat exchange mediums flowing circularly in one of the plurality of capillary tube cavities.

3. The temperature homogenizing container for the refrigerator according to claim 1, wherein each one of at least some of the plurality of capillary tube cavities comprise a first opening and a second opening provided oppositely along the extension direction of the each capillary tube cavity and the heat exchange medium is capable of flowing into and out of the each one of the at least some of the plurality of capillary tube cavities through the first opening and the second opening.

4. The temperature homogenizing container for the refrigerator according to claim 3, wherein the refrigerator comprises a cooling system pipeline, and the at least some of the plurality of capillary tube cavities communicate with the cooling system pipeline through the first openings and the second openings of the at least some of the plurality of capillary tube cavities so that the heat exchange medium is capable of flowing circularly in the at least some of the plurality of capillary tube cavities and the cooling system pipeline.

5. The temperature homogenizing container for the refrigerator according to claim 1, wherein the container is provided as an inner container of the refrigerator.

6. The temperature homogenizing container for the refrigerator according to claim 1, wherein the body comprises a first wall and a third wall provided oppositely, a second wall and a fourth wall provided oppositely and a bottom wall perpendicular to the first wall, the third wall, the second wall and the fourth wall, and at least some of the plurality of capillary tube cavities are provided throughout the first wall, the second wall, the third wall and the fourth wall successively along extension directions of the walls.

7. A refrigerator comprising a temperature homogenizing container and a cooling system, and the temperature homogenizing container comprising a body and an accommodating space enclosed by the body and provided for accommodating articles, wherein the body comprises a plurality of capillary tube cavities provided therein and provided for a heat exchange medium to flow, an inner wall of each capillary tube cavity of the plurality of capillary tube cavities being provided with a micro-tooth structure comprising micro combs and a plurality of comb grooves each of which is located between two adjacent micro combs, and the heat exchange medium being capable of flowing in the each capillary tube cavity along an extension direction of the each capillary tube cavity;

the body is integrally formed of a highly heat-conductive material through an extrusion process and then bending, the each capillary tube cavity is formed inside the body, the plurality of capillary tube cavities are distributed evenly side by side inside the body parallel to an inner surface of the body, each comb groove includes a valley away from a center of the each capillary tube cavity, each micro comb includes a peak close to the center of the each capillary tube cavity, and the valley and the peak are respectively provided with an arc shape.

8. The refrigerator according to claim 7, wherein the cooling system comprises an evaporator or a condenser provided on the outside of the container.

9. The refrigerator according to claim 7, wherein some of the plurality of capillary tube cavities are provided as independently closed spaces filled with one of a plurality of heat exchange mediums respectively, the heat exchange medium is one of the one of a plurality of heat exchange mediums flowing circularly in one of the plurality of capillary tube cavities.

10. The refrigerator according to claim 7, wherein each one of at least some of the plurality of capillary tube cavities comprise a first opening and a second opening provided oppositely along the extension direction of the each capillary tube cavity and the heat exchange medium is capable of flowing into and out of the each one of the at least some of the plurality of capillary tube cavities through the first opening and the second opening.

11. The refrigerator according to claim 10, wherein the refrigerator comprises a cooling system pipeline, and the at least some of the plurality of capillary tube cavities communicate with the cooling system pipeline through the first openings and the second openings of the at least some of the plurality of capillary tube cavities so that the heat exchange medium is capable of flowing circularly in the at least some of the plurality of capillary tube cavities and the cooling system pipeline.

12. The refrigerator according to claim 7, wherein the container is provided as an inner container of the refrigerator.

13. The refrigerator according to claim 7, wherein the body comprises a first wall and a third wall provided oppositely, a second wall and a fourth wall provided oppositely and a bottom wall perpendicular to the first wall, the third wall, the second wall and the fourth wall, and at least some of the plurality of capillary tube cavities are provided throughout the first wall, the second wall, the third wall and the fourth wall successively along extension directions of the walls.

* * * * *